US010041218B2

(12) United States Patent
Sanchez De La Cruz

(10) Patent No.: US 10,041,218 B2
(45) Date of Patent: Aug. 7, 2018

(54) ROADWAY BARRIERS IMPACT DETECTION SYSTEM

(71) Applicant: Jose Manuel Sanchez De La Cruz, Barcelona (ES)

(72) Inventor: Jose Manuel Sanchez De La Cruz, Barcelona (ES)

( * ) Notice: Subject to any disclaimer, the term of this patent is extended or adjusted under 35 U.S.C. 154(b) by 153 days.

(21) Appl. No.: 14/773,699

(22) PCT Filed: Nov. 25, 2013

(86) PCT No.: PCT/ES2013/070815
§ 371 (c)(1),
(2) Date: Sep. 8, 2015

(87) PCT Pub. No.: WO2014/135720
PCT Pub. Date: Sep. 12, 2014

(65) Prior Publication Data

US 2016/0024731 A1 Jan. 28, 2016

(30) Foreign Application Priority Data

Mar. 5, 2013 (ES) ..... 201330308

(51) Int. Cl.
*E01F 15/08* (2006.01)
*E01F 15/04* (2006.01)
(Continued)

(52) U.S. Cl.
CPC ..... *E01F 15/085* (2013.01); *E01F 15/043* (2013.01); *E01F 15/0453* (2013.01);
(Continued)

(58) Field of Classification Search
CPC ..... E01F 15/085; E01F 15/081; E01F 15/086; E01F 15/043; E01F 15/0453; E01F 15/083; G08G 1/0116; G08G 1/00; G08G 1/08; G08G 1/166; G08G 1/167
USPC ..... 404/6; 256/13.1
See application file for complete search history.

(56) References Cited

U.S. PATENT DOCUMENTS 3,704,861 A * 12/1972 Glaesener ..... E01F 15/0453 256/1
3,859,482 A * 1/1975 Matsui ..... B60R 21/013 200/61.08
(Continued)

FOREIGN PATENT DOCUMENTS

DE 4116317 A1 * 11/1992 ..... E01F 15/0453
WO WO 0009812 A1 * 2/2000 ..... E01F 15/043
WO WO 2013030418 A1 * 3/2013 ..... E01F 7/06

*Primary Examiner* — Jonathan P Masinick
(74) *Attorney, Agent, or Firm* — Hoglund & Pamias, PSC; Roberto J. Rios

(57) ABSTRACT

The guardrail, which may take the form of various types of guardrails, is noteworthy in that it includes an impact detector/indicator, for indicating the location of the guardrail involved in an impact or accident and also for notifying the accident and the place where it occurred to a traffic control station or to public assistance personnel. The detector/indicator includes a convex protective plate (2) attached to the front of the guardrail (1) with which it is used, said plate (2) protecting a connection box (3) and a tube (4) so as together to create a means for detecting and communicating the impact that occurred, also having an indicator light (5) for flagging up the impact, said indicator (5) being positioned on a support plate (6) secured above the protective plate (2).

14 Claims, 5 Drawing Sheets

(51) Int. Cl.
*G08B 25/00* (2006.01)
*G08G 1/095* (2006.01)
*G08B 25/08* (2006.01)

(52) U.S. Cl.
CPC ..... *E01F 15/081* (2013.01); *E01F 15/083* (2013.01); *E01F 15/086* (2013.01); *G08B 25/00* (2013.01); *G08G 1/095* (2013.01); *G08B 25/08* (2013.01)

(56) References Cited

U.S. PATENT DOCUMENTS 4,681,302 A * 7/1987 Thompson ..... E01F 8/0035 256/13.1
5,847,643 A * 12/1998 Keith ..... B60Q 1/52 180/274
5,957,435 A * 9/1999 Bronstad ..... E01F 15/143 256/13.1
6,693,549 B2 * 2/2004 Stuetzler ..... B60R 21/0136 180/274
7,257,875 B2 * 8/2007 Masinelli ..... E01F 15/0423 256/13.1
9,518,881 B2 * 12/2016 Hammerschmidt .... G01L 1/142
2002/0000543 A1 * 1/2002 Arthur ..... E01F 15/0492 256/13.1
2008/0308779 A1 * 12/2008 Yu ..... E01F 15/0453 256/13.1
2010/0085171 A1 * 4/2010 Do ..... G08B 21/06 340/426.1
2012/0150966 A1 * 6/2012 Fan ..... G06Q 10/107 709/206
2013/0108361 A1 * 5/2013 Mustafa ..... B25B 5/101 404/6

* cited by examiner

ROADWAY BARRIERS IMPACT DETECTION SYSTEM

OBJECTIVE OF THE INVENTION

The present invention relates to a traffic protection barrier for roads that is provided with an impact detection-signalling device, whose obvious purpose is to detect any type of impact to the traffic protection barrier from a vehicle and additionally activate a signalling means for the associated impact and even establish communication with an emergency service centre, advising the location of the impact, that is of the accident.

The objective of the invention is to warn the emergency services of an impact or accident occurring at a specific point on a public road provided with a traffic protection barrier equipped with the detection-signalling device relating to the invention and also signal to other drivers and other people the fact that an impact or accident has occurred involving the traffic protection barrier.

The detection-signalling device is applicable to any type of traffic protection barrier or fence, whether concrete, metal, wood, plastic or other material regardless of its shape or configuration.

The invention is equally effective in any type of barrier intended for implementation of the detector, which has been conceived and built to substitute for the classic metal crash barriers with or without protection for motorcyclists or those made of concrete that are mounted laterally alongside roads and which serve as protection for the vehicle, preventing them from falling down a embankment in case of carelessness, accident, etc.

Another objective of the invention is to provide a barrier with greater elasticity than the conventional ones (using recyclable material) that is less traumatic for, for example, motorcyclists who may hit the barrier itself after an accident.

BACKGROUND OF THE INVENTION

The traffic protection barriers that are installed on public roads and motorways have a disadvantage in that, should an impact or accident occur at a specific point on the public road or motorway where a barrier has been installed, the accident or impact can only be detected by the motorists passing this place at that time, there is no instantaneous warning given to public personnel or the emergency services, nor signalling that an accident or impact has occurred at this point.

The normal type of barrier is the classic crash barrier made of corrugated sheet metal fixed by bolts to posts anchored vertically into the ground; on the other hand concrete barriers are made of reinforced concrete blocks that are also anchored to the road surface using metal abutments.

These barriers have disadvantages such as their rigidity, which in the case of light impacts can significantly damage a vehicle; and on the other hand, if they are impacted by a motorcyclist they can cause fatal injuries in the worst cases or at least severe traumatic injuries to a motorcyclist involved in an accident.

DESCRIPTION OF THE INVENTION

The proposed barrier is expected to solve the problems described above as its main purpose is to detect an impact against the barrier in which a detection-signalling device is located to warn public or emergency personnel, to communicate the exact place where this occurred, which will correspond to the place where the detection-signalling device is installed in the barrier and also by signalling that an accident or impact against the barrier has occurred in the place where this event took place.

More specifically the detection-signalling device incorporated in the barrier forms part of an impact detection and monitoring system, that is, a sensor duly protected by a junction box in combination with a protective metal plate that is fixed over a specific point on the side of the traffic protection barrier and whose metal plate is convexly curved in relation to the front of the barrier, protecting the junction box and the sensor placed behind this protective plate, which is complemented by an angled metal sheet extending upwards and attached to the barrier to which it is applied, and finished at the top in a horizontal section, forming the means of support for a signalling device, that is a signal light as a means of warning that an impact has occurred at that place.

The fixing of the convexly curved protective plate and the support for the signal light can all be performed using screws, compressed air nail gun or any other appropriate system.

This convexly curved protective plate can be curved, trapezoidal, rectangular or any other configuration that can be deformed by an impact and establish the activation of the elements for detecting and signalling an impact.

Obviously the invention's detection-signalling device is applicable in any type of traffic protection barrier, that is, all those used conventionally, whether for roads for cars, motorcycle or lorry lanes and roads for all types of vehicle in general.

This allows a system to be established that is capable of detecting impacts produced by a vehicle against a traffic protection fence, activating a danger signalling system that is integrated into the fence as well as communicating with the emergency services that an accident has occurred in a specific, determined place where the previously described detection-signalling device is located.

Under the detector's sealed junction box there is an interior tube whose function is to protect the relevant cabling used and even be the means for detecting the impact itself, so that the integrated assembly contains the means for monitoring the impact, a means for bidirectional communication with a traffic control centre or emergency service personnel and the means for triggering the warning signal light.

In an alternative embodiment and when specifically dealing with the invention's application to concrete barriers, a enveloping plate is planned for the side and upper surfaces of said barrier, the plate is hollow and includes the corresponding detector and externally the impact signalling light. In this case the external surface of the plates include means for coupling together the plates of a number of units provided in a continuous or contiguous stretch of concrete barrier.

As an option it is also anticipated that the barrier could incorporate an LCD or LED screen or similar that could be used to display warning signs regarding specific conditions that may occur at certain moments, such as, for example, warning of accidents, signalling areas where there is danger of ice or fog, etc.

Similarly, the barrier could also incorporate a surface destined for the inclusion of advertisements.

When the barrier is of the type formed by an undulating body fixed to the classic vertical posts anchored to the ground, it is planned to be materialised in recycled rubber. This quality provides a greater elasticity to the assembly, minimising the damage to vehicles and significantly reducing serious or fatal injuries to motorcyclists.

More specifically, it consists of a body of recycled rubber with a pair of undulations corresponding with its upper half, that contain an embedded metal structure made of metal splints that correspond with the fence's two undulations, these splints are also located in a part near the lower extreme to provide the barrier with sufficient rigidity to support impacts and fulfil its planned function, while by its very nature it will be flexible enough to absorb a significant part of a vehicle's impact energy, and more importantly, avoid serious or even fatal injuries in motorcyclists.

The barrier is complemented by a rear connecting splint and a rear bracket for fixing to the corresponding vertical ground-anchored posts, using mounting bolts and shear bolts.

A means for locking and fixing through the rear joining splint, attachment bracket or appropriate means to this effect is provided at the ends of the rubber element constituting the barrier and coinciding with the ends of the splints that constitute the interior metallic structure.

DESCRIPTION OF THE DRAWINGS

To complement the description being made and in order to aid a better understanding of the invention's characteristics the present specification is accompanied by, as an integral part thereof, a figure in which, in an illustrative and non-limiting manner, is shown the following.

PREFERRED EMBODIMENT OF THE INVENTION

Figure 1:
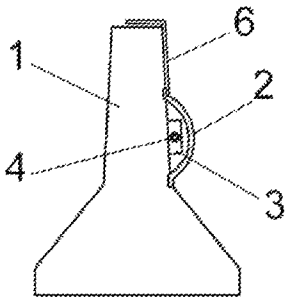
FIG. 1.—Shows a side view of the traffic protection barrier provided with an impact detection-signalling device, in this case materialised in concrete.
Figure 2:
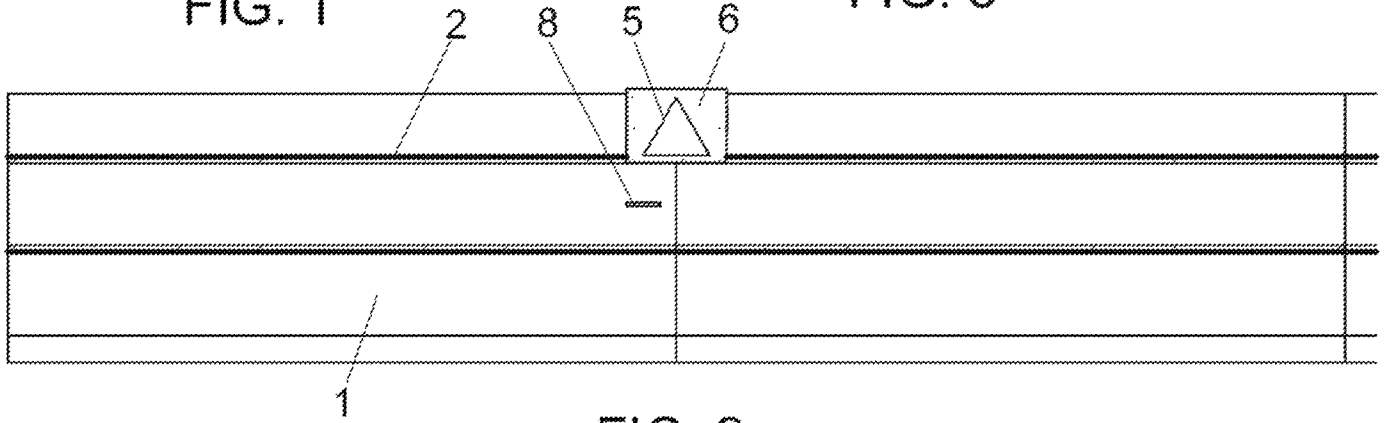
FIG. 2.—Shows a front view of the assembly represented in the previous figure.

As can be seen in the aforementioned figures the traffic protection fence (1) that is the object of the invention can be of concrete as represented in FIGS. 1 and 2, or of plastic, wood, metal or any other type of traffic protection fence, it incorporates a detection-signalling device that is formed from a curved plate (2) fixed by a suitable means to the front of the barrier (1), and whose protection plate (2) houses inside a sealed junction box (3) with an interior tube (4) to protect the cabling and establish the detection should an impact to the barrier occur, particularly an impact to the protection plate (2).

That is, the whole assembly forms an impact detector, where the junction box (3) in combination with the interior tube (4) establish a communication means with a traffic centre, the emergency services or any other entity, as well as activating a signal light (5) located on a support plate (6), fixed above the protection plate (2) and attached, as shown in FIG. 1, to the surface or upper part of the barrier (1), and where the plate (6) supporting the signal light (5) is made with an angled profile with a upper, horizontal section that is located above the upper edge of the barrier (1), and it has holes that are referenced with (7) and that are clearly shown in FIG. 2.

A signal light (8) is also planned for the protection plate (2), as can also be seen in FIG. 2.

The signal light (5) indicates that an accident or impact against the fence (1) has occurred and it can be a triangle-shaped hazard signal for the motorists, motorcyclists, etc. that may be approaching the impact or crash site at that moment.

Figure 3:
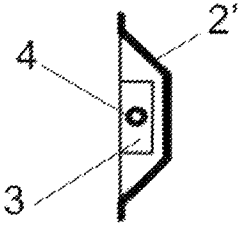
FIG. 3.—Shows a side detail of the protection panel that is used in the barrier's detection-signalling device, in this embodiment with a trapezoidal configuration as an alternative to the curved configuration shown in FIGS. 1 and 2.

Optionally, and as shown in FIG. 3, the protection plate, instead of being curved as represented in FIGS. 1 and 2 is a protection plate (2') with a trapezoidal configuration with the same function as previously described but with a different configuration, although this is not crucial as the configuration can be variable, although it must always have a curved or polygonal configuration or other form to protect the junction box (3) and the interior tube (4) containing the means for detection, monitoring and communication.

Figure 4:
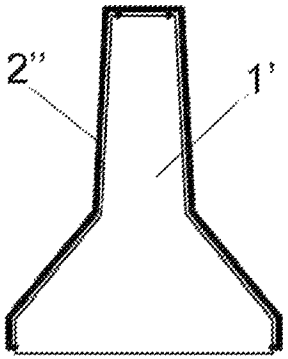
FIG. 4.—Shows an elevated view of a concrete barrier with an impact detection-signalling device, made of a hollow sheet supported both laterally and in its upper part to the barrier's main structure.
Figure 5:
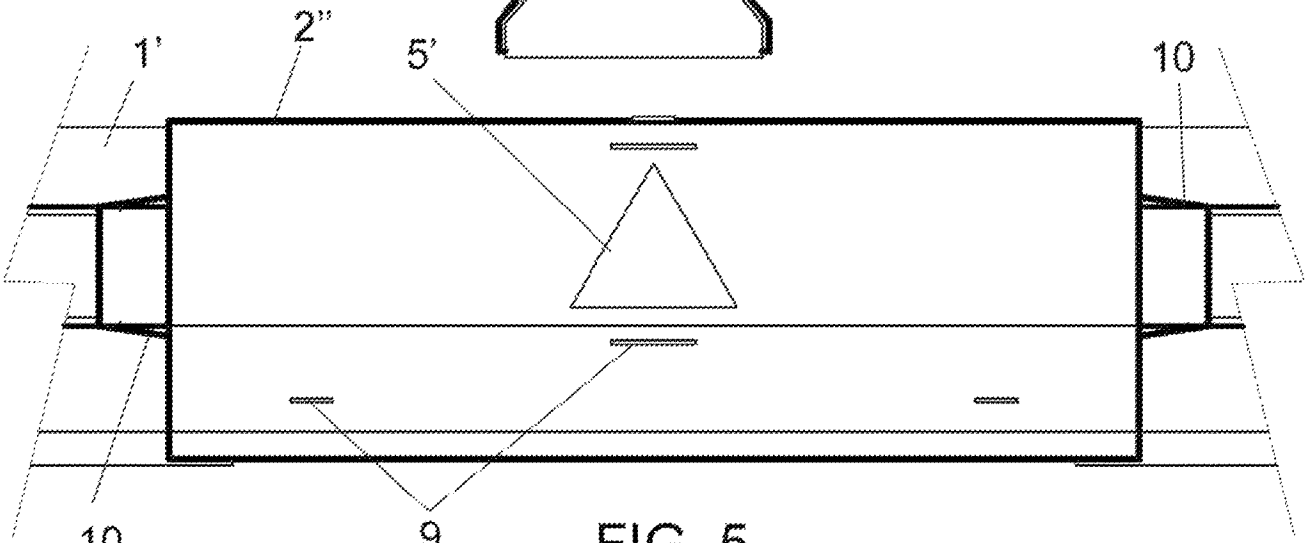
FIG. 5.—Shows a frontal view of the application corresponding to the enveloping plate incorporating the invention's barrier mounted detection-signalling device, with the end elements as means for coupling with adjacent barriers or contiguous sections of barrier.
Figure 6:
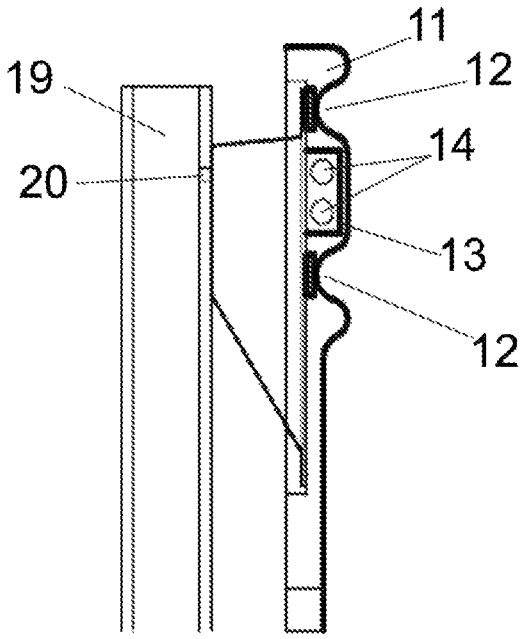
FIG. 6.—Shows a profile view of an alternative embodiment for the invention's barrier.
Figure 7:
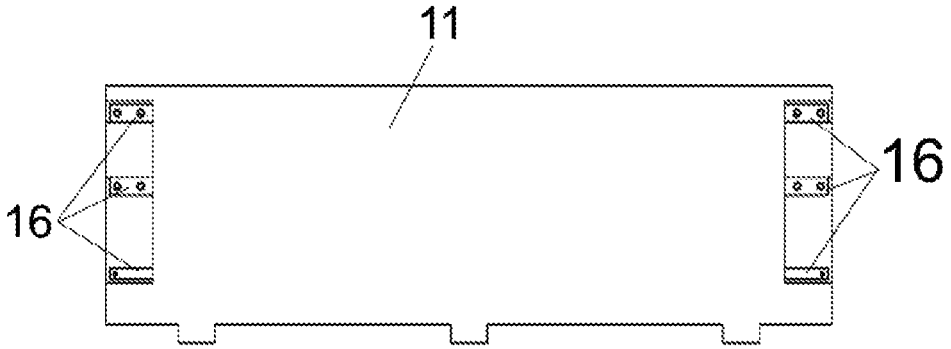
FIG. 7—Shows a rear plan view of the barrier represented in FIG. 6 without a rear joining plate between sections of barrier, without the rear support for joining with the post, or the fixing post.
Figure 8:
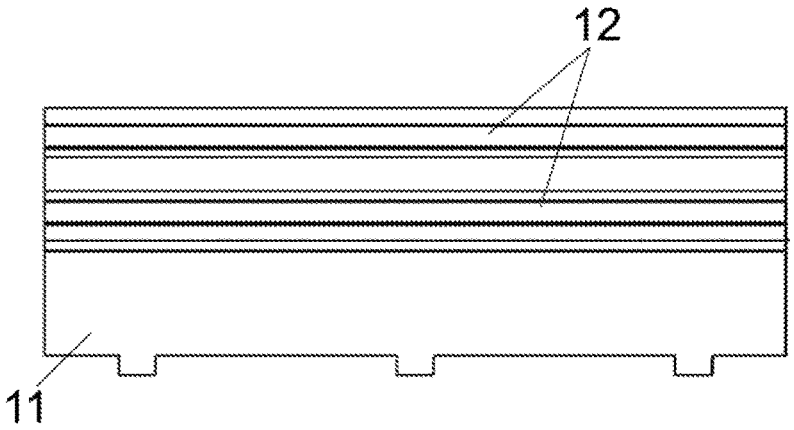
FIG. 8.—Shows a front view of the assembly represented in FIG. 6.

In the alternative embodiment shown in FIGS. 4 and 5 it can be seen that the invention's detection-signalling device has been applied to a concrete barrier (1'), in this case the invention is made of a plate (2") that envelops the side and top surface of the barrier (1'), this plate (2") is hollow to house the corresponding impact detector, while the exterior includes the corresponding signal light (5').

The means for other devices are also provided within the plate (2"), such as a signal light (9) and others.

In any case, the ends of the plate (2") have coupling elements (10) for connecting the plates (2") of the concrete blocks (1') corresponding to the barrier in a continuous disposition, as shown in FIG. 5.

In one of the invention's alternative embodiments, as shown in FIGS. 6 to 10, the barrier may be configured with a rubber body made of recycled tyres and other similar materials (11), and contain a pair of longitudinal undulations (12) along its upper half, whose form and design may be that described in those figures or vary depending on location and on the degree of danger for vehicles or the required level of containment.

Figure 9:
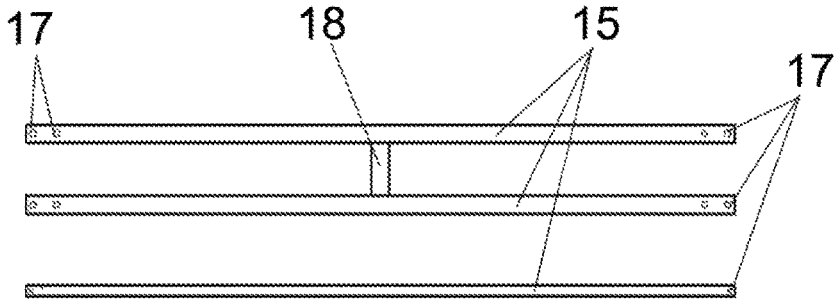
FIG. 9.—Shows a longitudinal detail of the three splints involved in the barrier shown in FIGS. 6 to 9, to give it rigidity and the corresponding bracket for fixing these splints transversely to the post anchored to the ground.

This main body is reinforced internally by a metal structure, particularly visible in FIG. 9.

The body of the fence-barrier incorporates some internal ducts (14) necessary for incorporating the designed monitoring technology.

Three splints (15) are provided that are fixed using screws and other conventional means to their respective supports (16) provided at the ends of the barrier's body (11), for which the ends of these splints (15) have holes (17) for screws and other appropriate fixing elements. The upper splints are joined to form an assembly using a connecting splint (18).

Figure 10:
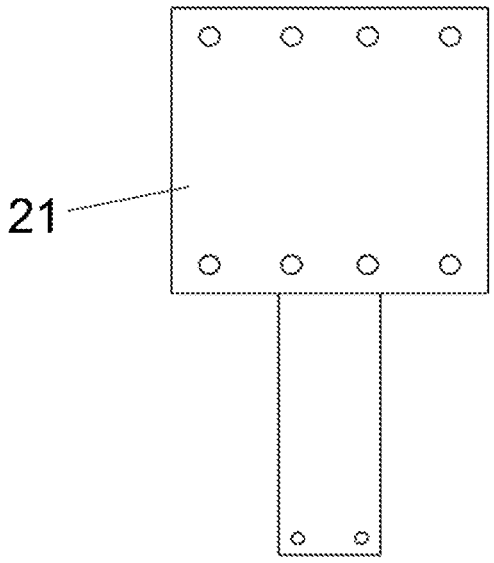
FIG. 10.—Shows a rear view of the rear joining plate between barrier sections.

The join between sections of fence-barrier are made using a metal plate (21), as shown in FIG. 10, whose shape and design can be that described in the accompanying figures or the design may vary in relation to the installation site depending on how dangerous it is for vehicles or the required level of containment.

The joint between the fence-barrier and the post that acts as a vertical support is performed by a metal connecting piece, anchored to the post using a shear bolt (20).

The fence-barrier is anchored to the ground or edge of the roadway by inserting a post that acts as a vertical support for the fence-barrier (19), forming a C type profile, but not ruling out other shapes or measures for the section and profile type.

The fence-barrier is designed to be able to house impact monitoring systems, bidirectional communication with a traffic control centre, signal light systems. As well as materials or substances for efficiently obtaining a suitable reflectance and/or phosphorescence for night driving. A slit (13) is made in the ends of the rubber to house the box containing the control systems, the box being protected by the rear plate as shown in FIG. 10.

The fence-barrier is designed to be able to include the materials or substances necessary to obtain the tones and colours required.

The fence-barrier is designed to be able to include the materials or substances necessary to efficiently obtain the required levels of resistance or friction depending on how dangerous a siting location is for vehicles or the required level of containment.

Two of the splints are embedded within the body (11) of the barrier, corresponding to the troughs of the two upper undulations in the barrier's body, while the lower splint is located at a level close to the lower edge.

The invention claimed is:

1. A roadway barriers impact detection system comprising: a body made of an impact-absorbing material having an elongated rectangular configuration with a front surface, a rear surface and lateral ends, said front surface includes an upper undulated portion, a lower undulated portion and a hollow portion positioned between said upper and lower undulated portions and being provided proximate to an upper edge of said front surface and longitudinally extending between said lateral ends, wherein an upper reinforcing solid plate is provided inside said body longitudinally extending between said lateral ends in alignment with said upper undulated portion, a lower reinforcing solid plate is provided inside said body longitudinally extending between said lateral ends in alignment with said lower undulated portion and a bottom reinforcing solid plate provided inside said body proximate to a lower edge of said front surface and longitudinally extending between said lateral ends, the hollow portion includes a junction box and at least one internal tube housing an impact detecting apparatus that detects an impact to said body and communicates said detected impact to a remote location.

2. The system of claim 1, further comprising a connecting reinforcing solid plate provided inside said body and coupled to said upper and lower reinforcing solid plates.

3. The system of claim 1, wherein said junction box and at least one internal tube are located inside said hollow portion so that the at least one internal tube longitudinally extends between lateral slits of said hollow portion provided at said lateral ends, respectively.

4. The system of claim 1, wherein said lateral ends comprise lateral plates for fixing ends of the upper reinforcing solid plate, lower reinforcing solid plate and bottom reinforcing solid plate to said lateral ends.

5. The system of claim 1, wherein said body further comprises a portion for advertisement placement.

6. The system of claim 1, wherein said body is made from rubber.

7. The system of claim 1, wherein said body is made from recycled rubber.

8. The system of claim 1, further comprising a screen showing warning information.

9. The system of claim 1, further comprising a local visual alert element.

10. The system of claim 9, wherein said local visual alert element comprises a hazard indicating alert in the form of a triangle.

11. The system of claim 1, wherein said impact detecting apparatus comprises an impact detection sensor and cabling used to bi-directionally communicate between said impact detecting apparatus and said remote location.

12. The system of claim 1, further comprising a metal connecting bracket configured to coupled said body to a roadway post.

13. The system of claim 12, wherein said metal connecting bracket is connected to a lateral end of said body.

14. The system of claim 1, wherein a plurality of bodies is connected side-by-side by a metal joining plate coupled to one lateral end of a body and another lateral end of an adjacent body.

* * * * *